US006968580B1

(12) United States Patent
Chang Chien

(10) Patent No.: US 6,968,580 B1
(45) Date of Patent: Nov. 29, 2005

(54) DOUCHE

(76) Inventor: Sung Shan Chang Chien, PMB#1008, 1867 Ygnacio Valley Rd., Walnut Creek (TW) 94598

( * ) Notice: Subject to any disclaimer, the term of this patent is extended or adjusted under 35 U.S.C. 154(b) by 0 days.

(21) Appl. No.: 10/915,486

(22) Filed: Aug. 11, 2004

(51) Int. Cl.[7] ..... A47K 3/20
(52) U.S. Cl. ..... 4/420.4; 4/420.2; 4/443
(58) Field of Search ..... 4/420.1–420.5, 4/443, 448

(56) References Cited

U.S. PATENT DOCUMENTS 1,752,698 A * 4/1930 Rogers et al. ..... 604/114
4,622,704 A * 11/1986 Chung ..... 4/443
5,090,067 A * 2/1992 Cogdill ..... 4/420.2
5,991,937 A * 11/1999 Safara ..... 4/420.2
6,675,400 B1 * 1/2004 Chang Chien ..... 4/443

* cited by examiner

*Primary Examiner*—Justine R. Yu
*Assistant Examiner*—Huyen Le
(74) *Attorney, Agent, or Firm*—Leong C. Lei

(57) ABSTRACT

A douche (2) includes a cistern, a filtration vessel above the cistern, and a heater at the bottom, and a closed power cabinet to the lower by the cistern; the power cabinet contains a pump with one end of the pump connected to the cistern and the other end extending out of the power cabinet with a supply line and connected to a serpentine pipe having one end disposed with a lever nozzle, a recessed hole on the power cabinet for the lever nozzle to hook on, and the heated water is pumped to the lever nozzle.

4 Claims, 4 Drawing Sheets

DOUCHE

BACKGROUND OF THE INVENTION (a) Technical Field of the Invention

The present invention is related to a douche, and more particularly, to one in a construction to allow easier improve assembly and more convenience in use.

(b) Description of the Prior Art

For hygienic purposes, a flush toilet is provided with a control valve connected via supply line to a refill valve in a cistern and a lever nozzle stick out in the toilet to deliver water at a pressure regulated by the control valve through the lever nozzle for the user to rinse after the use of the toilet. However, such a system is fixed at where between the toilet and the cistern, it creates a problem to clean the bathroom. The scope of the rinse is restricted since the lever nozzle is positioned in the toilet. The nozzle is vulnerable to be contaminated by the urine or excrements to prevent from any hygienic use. To correct those flaws, this applicant has invented a douche granted with a utility patent (U.S. Pat. No. 91,299,275).

Referring to FIG. 1, the douche is essentially comprised of a main unit 1, a pump 2 and a lever nozzle for rinse. Wherein, the main unit 1 is divided into two chambers with a partitioning board 11. The upper chamber 12 is fixed at its top opening a funnel water inlet 13 and a layer of filtration sponge 14 is disposed at the bottom of the water inlet 13 to prevent contaminants from entering into the upper chamber 12. Meanwhile, a heating element 15 is provided on the partitioning board 11 to heat the water admitted by the filtration sponge 14 and the pump 12 is fixed at where beneath the partitioning board 11.

A switch 16 is provided on the outer wall closer to the bottom of the main unit 1. The pump is connected with a supply line 21 to the upper chamber, and with a water pipe 22 to the lever nozzle 3, which is hooked onto a water pipe accommodation mechanism disposed by the upper end of the main body. The water pipe accommodation mechanism contains a reel 161 to wind up the water pipe and the reel 16 contains a return spring to freely wind up or delver a water pipe 31. When the lever nozzle is pulled externally, the water pipe 31 allows extension for a proper length. When the lever nozzle 3 is hooked on the accommodation mechanism 17, it is automatically to be wound up by the reel 161. Furthermore, a touch switch 32 is provided on the lever nozzle and is connected with a power cable 33 to the pump 2. The depressed touch switch 32 starts the pump 2 to suck in the heated water from the upper chamber 12 through the supply line 21 to be ejected from the lever nozzle 3 following the water pipe 22. A handle 34 and a lever 35 of the lever nozzle 3 are screwed to each other and a nozzle 36 is disposed at a right angle to the head of the lever 35. Upon completing the use of the toilet, the lever nozzle 3 is fetched from the water pipe accommodation mechanism 17 and extended into the toile, then the touch switch is depressed for the nozzle at the head of the lever nozzle 3 to eject lukewarm water to allow the user adjust the ejection angle of the lever nozzle 3.

Whereas the douche relates to a standalone system and provided with casters 18 at the bottom of the main unit 1, it may be placed wherever is convenient to the user. The lever nozzle 3 will not be contaminated since it is placed in the toilet when the use is required. For even more personal sense, each user may have his/her own lever 35 and connect it to the handle 34 of the lever nozzle 3 whenever he/she uses the toilet and then remove the lever 35 from the handle 34 after the use. However, the douche may be further improved to upgrade its functions.

SUMMARY OF THE INVENTION

The primary purpose of the present invention is to provide a douche that permits easier assembly and more convenient use. To achieve the purpose, a cistern is provided at where by a main unit of the douche. A filtration vessel is provided on the top of the cistern, and a heater is provided at the bottom of the cistern. A closed power cabinet is provided at where below the side of the cistern. A pump is provided at the bottom in the power cabinet. One end of the pump is connected to the cistern and the other end extending from the power cabinet and connected to a serpentine pipe disposed with a lever nozzle at its head. A recessed hole is provided on the power cabinet to be hooked on by the lever nozzle. The heated water is pumped to the lever nozzle for the rinse.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
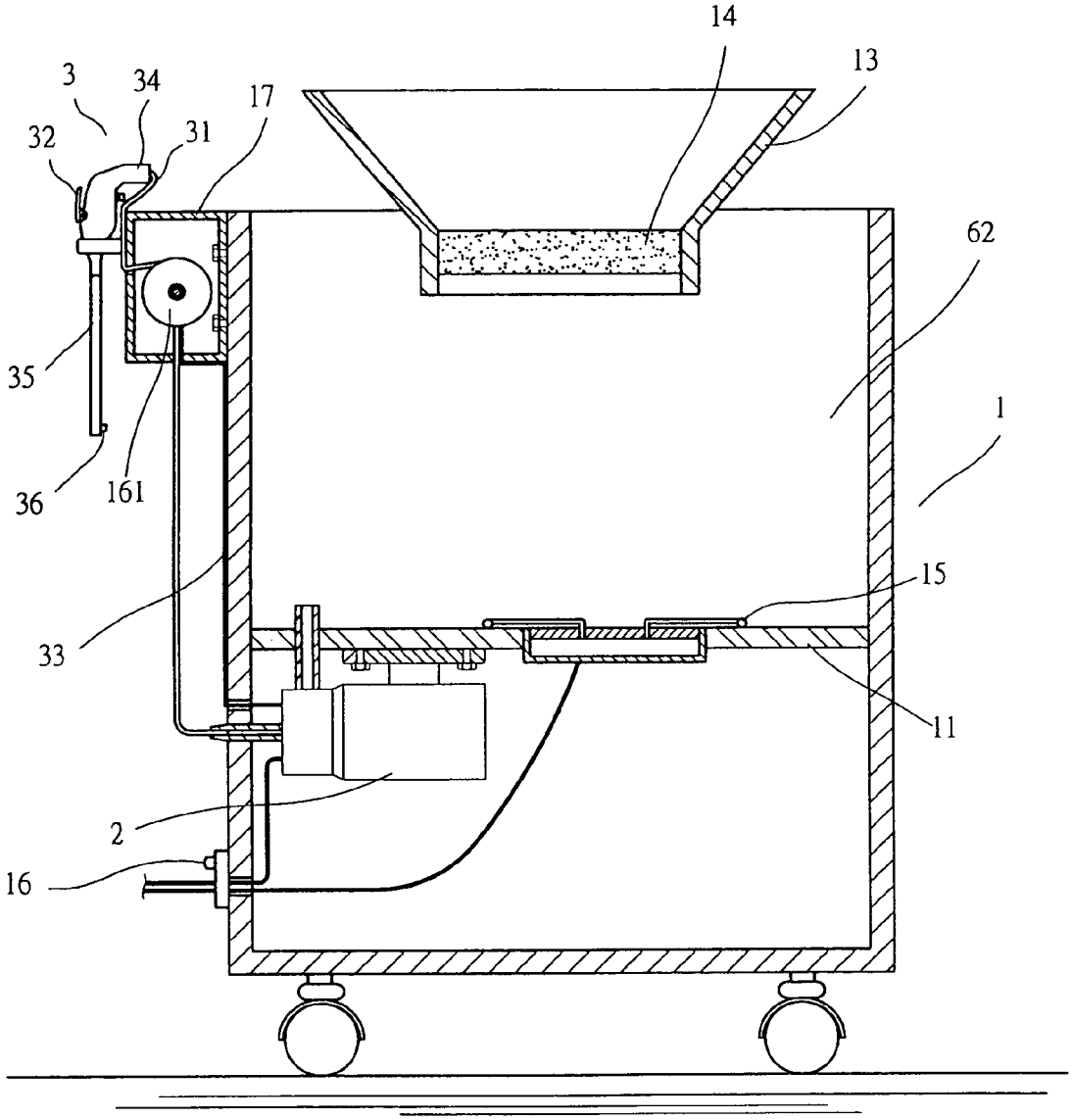
PRIOR ART FIG. 1
FIG. 1 is a perspective view as taught in a utility patent (U.S. Pat. No. 91,209,275).
Figure 2:
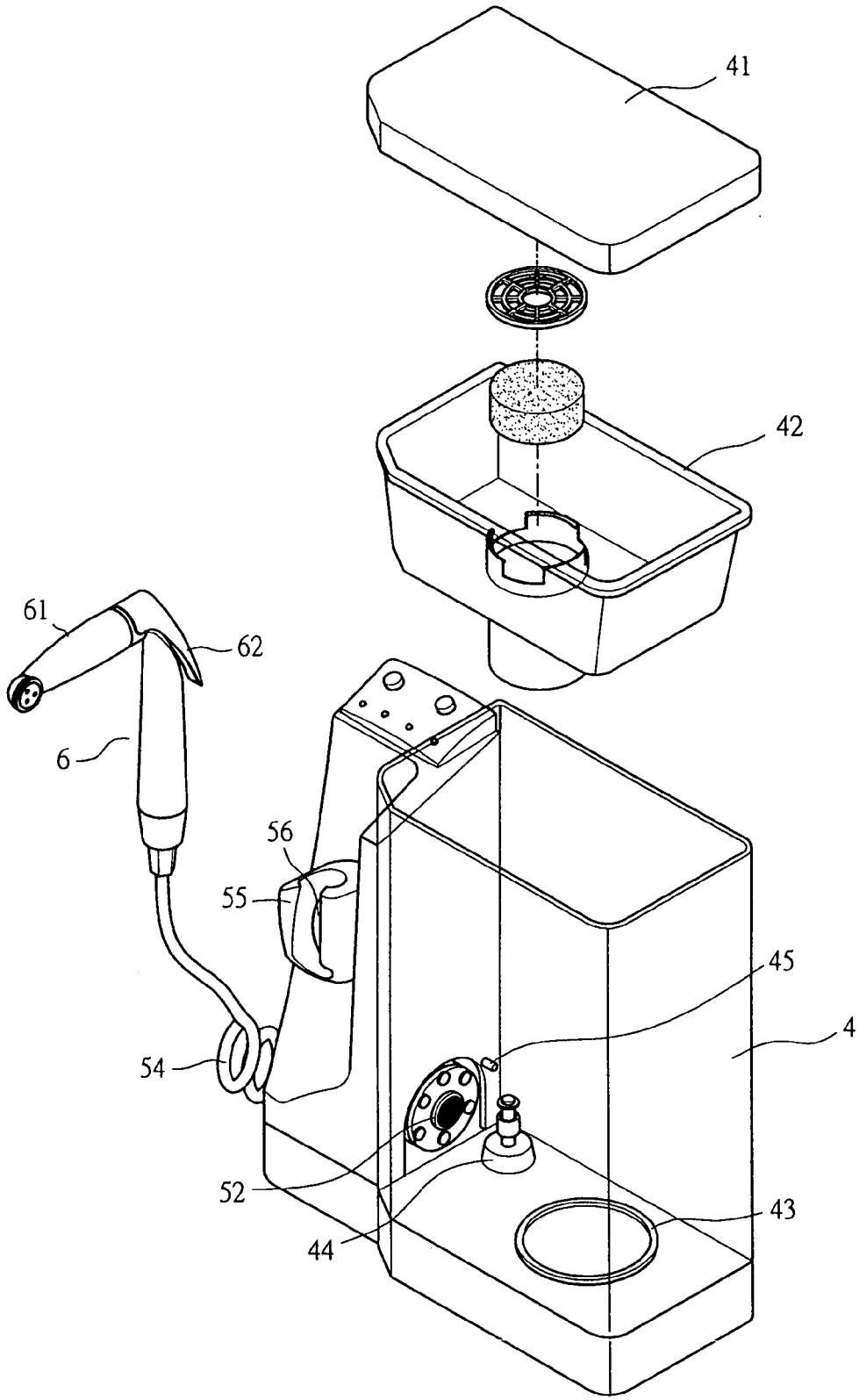
FIG. 2 is an exploded view of a preferred embodiment of the present invention.
Figure 3:
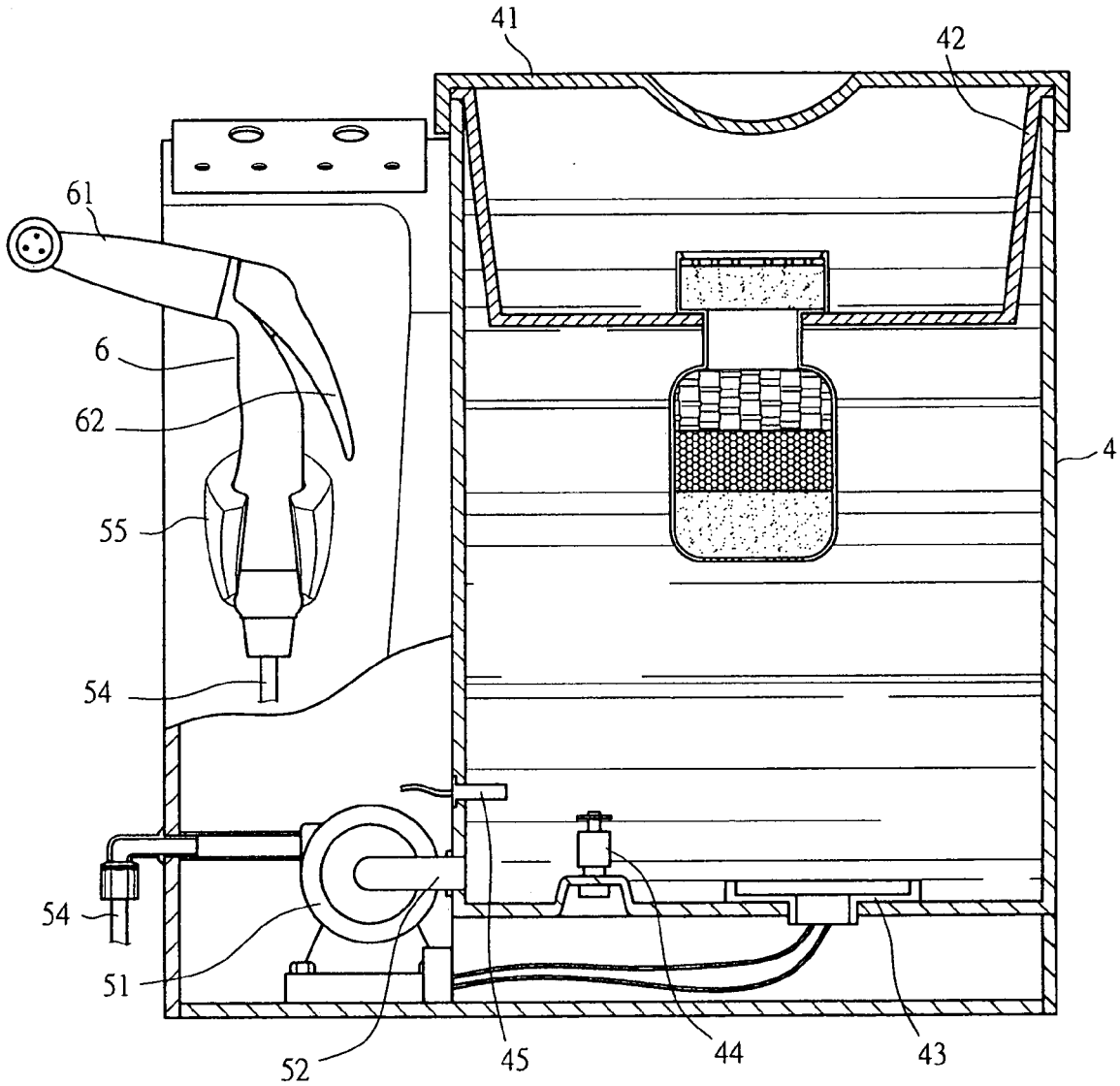
FIG. 3 is a sectional view of the preferred embodiment of the present invention.

Referring to FIGS. 2, and 3, a preferred embodiment of the present invention is essentially comprised of a cistern 4 provided on one side to the main unit of the douche; a closed power area 5 disposed at where below the side of the cistern 4. That is, both of the cistern 4 and the power area 5 are next to each other. Wherein, a lid 41 provided on top of the cistern 4 is used to cover up an opening to a filtration vessel 42. Multiple layers of filtration materials are filled in the filtration vessel 42. A heater 43 and a water level sensor 44 are provided at the bottom of the cistern 4. A pump 51 is provided at the bottom in the power area 5. One end of the pump 51 is connected with a supply line 52 to the cistern 4 and another end of the pump 51 extends out of the wall of the power area with a delivery line 53 and is further connected to a serpentine pipe 54. The head of the serpentine is connected to the lever nozzle 6 and a nozzle 61 is screwed to the head of the lever nozzle 6. A press switch 62 is provided at where appropriately to the lever nozzle 6 to control the passage inside the lever nozzle 6. When the switch 62 is depressed, the water is delivered and when released, blocked. A recessed holder 55 is provided on the wall on the upper part of the power area 5 to lock the lever nozzle 6 in place when not used. A pressure switch 56 is provided on the inner wall of the holder 55 and connected to the power that activates the pump 51. Accordingly, when the lever nozzle 6 is hooked on the holder 55, the pressure switch is in turn depressed by the lever nozzle to interrupt the power supply to the pump 51. When the lever nozzle 6 is off hook from the holder 55, the pressure switch 56 is released from the lever nozzle 6 and the pump 51 is started. The pump 51 automatically jumps to stop operating upon the expiry of a preset length of time even the pressure switch 56 is not depressed within the preset time. The overload protection circuit for the pump 51 is of the prior art and will not be elaborated herein.

Whereas the pump 51 is provided in the power area 5 to the side of the cistern 5, concerns over the waterproof and fastness of the partitioning board and whether the partitioning board could withstand the weight of the pump 51 as found with the prior art are eliminated for assurance of the service life the pump 51. Multiple layers of filtration materials provided in the filtration tank 42 filter away foreign matters and minerals in the water in a more effective way to keep them away from being build up on the heater 43 for maintaining its normal function. Once the water level in the cistern 4 drops to a certain extent or the temperature of the water gets abnormally high, the water level sensor 44 provided at the bottom of the cistern 4 and a temperature sensor 45 is provided on the wall of the cistern 4. Once the water level drops to its lower limit or the water temperature gets too high, the overload protection circuit will automatically jump to kill the pump 5 for maintaining use safety.

Figure 4:
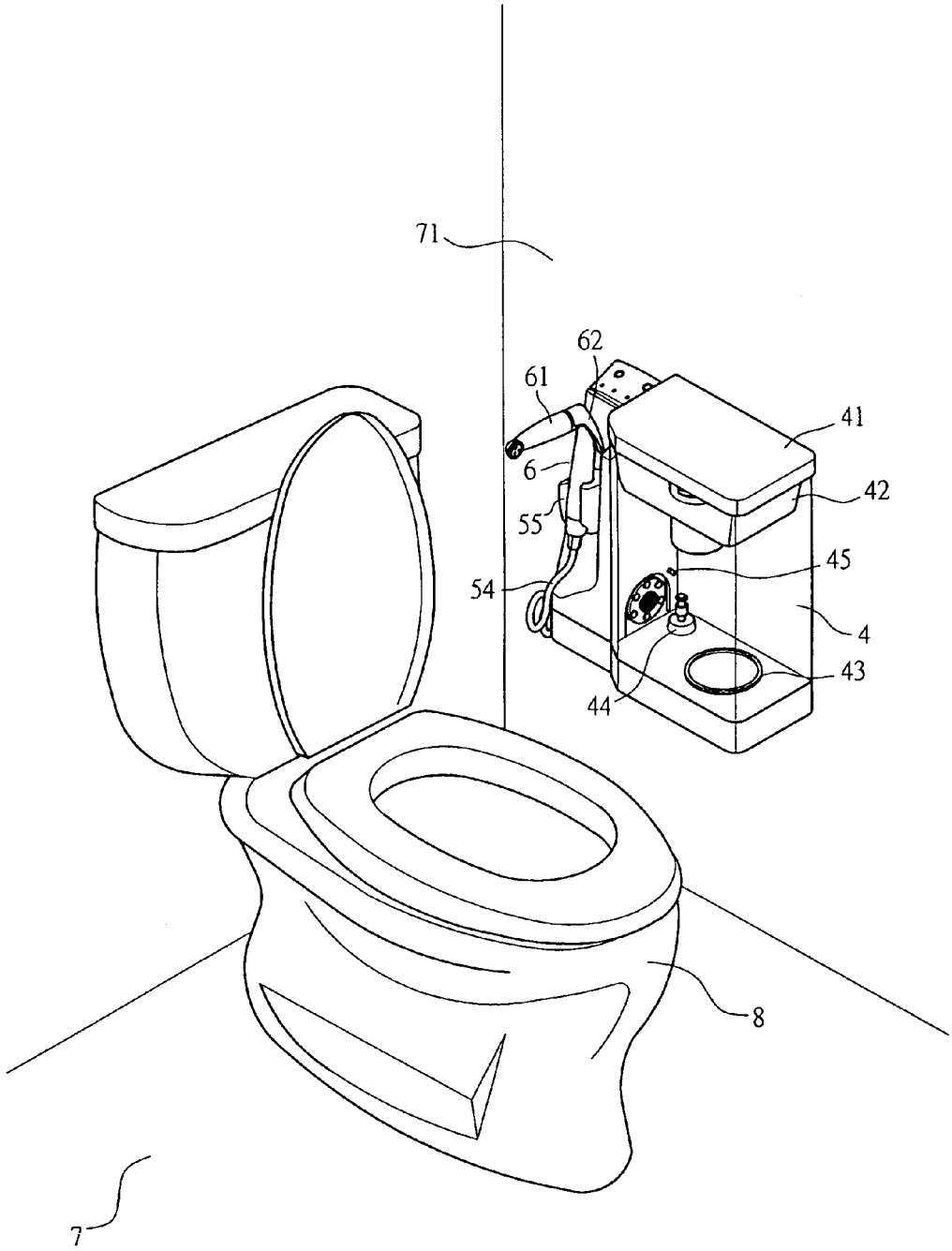
FIG. 4 is a schematic view showing an alternative fixation method for the present invention.

A serpentine pipe 54 is used in the present invention to replace the reel adapted with a return spring in the prior art for lowering production cost and easier assembly. The nozzle 61 may be screwed to the lever nozzle 6 to better meet personal hygiene since each member in the family has his/her own dedicated nozzle 61. Furthermore, as illustrated in FIG. 4, the douche is mounted to a wall 71 at where closer to a toilet 8 in a bathroom 7 to prevent from interfering with the personal movement in the bathroom 7.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A douche includes a cistern, a power area, and a lever nozzle for rinse; the cistern being provided with a lid to cover up an opening of a filtration tank, the filtration tank containing multiple layers of filtration materials, and a heater is provided at the bottom in the cistern; the power area having provided at its bottom a pump, one end of the pump being connected to the cistern with a supply line, another end of the pump extending out of the wall of the power area and connected to a serpentine pipe, and the head of the serpentine pipe being connected to the lever nozzle; the lever nozzle being provided on its body a press switch to control whether the inner passage of the lever nozzle permits free flowing of the water or is blocked; the cistern and the power area being provided next to each other, a recessed holder being provided on the wall in the upper power area to hold the lever nozzle when not used; a pressure switch being disposed in the holder and connected to the power source to activate the pump; the power supply to the pump being interrupted as long as the lever nozzle being hooked on the holder, and the pump being activated once the lever nozzle leaves the holder.

2. The douche of claim 1, wherein, the pump automatically jumps to stop operating if the user fails to depress the press switch within the preset time.

3. The douche of claim 1, wherein, a water level sensor is provided on the bottom of the cistern to automatically trip off the overload protection circuit in the pump for use safety once the water level in the cistern drops to a certain degree.

4. The douche of claim 1, a temperature sensor is provided to the wall of the cistern to automatically trip off the overload protection circuit in the pump for use safety once the water temperature become abnormally high.

* * * * *